US007604137B1

(12) United States Patent
Boraca et al.

(10) Patent No.: US 7,604,137 B1
(45) Date of Patent: Oct. 20, 2009

(54) DISPENSING RECEPTACLE FOR DISPENSING TWO LIQUIDS IN SERIES

(76) Inventors: Robert Boraca, Buffalo Grove, IL (US); Frances M. Van Puymbrouck, legal representative, 37190 N. Lake Shore, Lake Villa, IL (US) 60046; Bianca Kesler, 2 Villa Verde Dr., Suite#320, Buffalo Grove, IL (US) 60089

( * ) Notice: Subject to any disclaimer, the term of this patent is extended or adjusted under 35 U.S.C. 154(b) by 0 days.

(21) Appl. No.: 11/485,754

(22) Filed: Jul. 13, 2006

(51) Int. Cl.
*B65D 1/04* (2006.01)
*B65D 1/24* (2006.01)
*A61J 9/00* (2006.01)

(52) U.S. Cl. ..... 215/6; 215/11.4; 220/501

(58) Field of Classification Search ..... 215/11.5, 215/11.4, DIG. 8, 306, 11.6, 200, 380, 379; 220/507, 506, 23.88, 23.86, 375, 661, 660, 220/500; 222/134; 366/134, 133; D9/527, D9/526

See application file for complete search history.

(56) References Cited

U.S. PATENT DOCUMENTS 598,231 A * 2/1898 Roderick. ..... 215/11.5
779,749 A * 1/1905 Tinling ..... 215/11.1
1,694,754 A * 12/1928 Porter ..... 215/378
2,885,104 A * 5/1959 Greenspan ..... 206/222
3,200,980 A * 8/1965 Jamell ..... 215/11.5
3,410,444 A * 11/1968 Morane ..... 206/219
3,768,683 A * 10/1973 Van Den Bosch ..... 215/11.5
D246,507 S * 11/1977 Danielson ..... D9/520
4,193,699 A * 3/1980 Haygeman et al. ..... 366/130
4,703,863 A * 11/1987 Kohus ..... 215/11.1
4,779,722 A * 10/1988 Hall ..... 206/221
4,856,995 A * 8/1989 Wagner ..... 433/215
5,060,811 A * 10/1991 Fox ..... 215/6
5,353,964 A * 10/1994 Liu et al. ..... 222/134
5,611,776 A * 3/1997 Simmons et al. ..... 604/65
5,617,966 A * 4/1997 Bral ..... 215/11.4
5,634,714 A * 6/1997 Guild ..... 366/130
5,897,007 A * 4/1999 Schein et al. ..... 215/11.1
5,960,971 A * 10/1999 Bral ..... 215/11.4
6,003,728 A * 12/1999 Elliott ..... 222/81
6,113,257 A * 9/2000 Sharon et al. ..... 366/130
6,116,439 A * 9/2000 Yaniv ..... 215/11.1
6,446,822 B1 * 9/2002 Meyers et al. ..... 215/11.5
6,666,345 B2 * 12/2003 Blanding ..... 215/11.1
2002/0035997 A1 * 3/2002 Shapira ..... 128/898
2006/0021996 A1 * 2/2006 Scott et al. ..... 222/145.5
2006/0213857 A1 * 9/2006 Chen et al. ..... 215/11.1
2008/0006597 A1 * 1/2008 Samson ..... 215/11.5

FOREIGN PATENT DOCUMENTS

EP 341632 A2 * 11/1989

* cited by examiner

*Primary Examiner*—Anthony D Stashick
*Assistant Examiner*—Robert J Hicks

(57) ABSTRACT

A fillable dispensing receptacle having a portion formed for containing a liquid to be dispensed subsequent to dispensing of another liquid. The receptacle has first and second reservoirs in series, with a normally closed, suction-activated, one-direction valve communicating between the first and second reservoirs. The valve is operable upon a predetermined suction in the first reservoir to open to permit expulsion of liquid from the second reservoir into the first reservoir after the liquid in the first reservoir has been consumed. The receptacle can be in the form of a flexible, disposable pouch or a container having an opening at one end for engagement of a removable nipple and having a filling implement for introducing cleansing agent into the second reservoir.

5 Claims, 3 Drawing Sheets

DISPENSING RECEPTACLE FOR DISPENSING TWO LIQUIDS IN SERIES

BACKGROUND OF THE INVENTION

This invention relates to fillable dispensing receptacles, and in particular to a receptacle having a portion formed for containing a liquid to be dispensed subsequent to another liquid contained in the receptacle. The invention has particular utility as a nursing or baby bottle for dispensing a mouth cleansing agent, such as water, after the remainder of the bottle has been consumed, but also has utility for other purposes, including mouth cleansing for adults.

The typical baby bottle has a single chamber, where liquid is introduced and then the contents are consumed by a baby or other individual utilizing the bottle. There are many different kinds of baby bottles, including bottle holders with disposable flexible pouches and rigid bottles that are used and reused many times.

One concern with infants and young children when using baby bottles is to make sure that, to the extent possible, tooth decay is avoided. When a sugared beverage is consumed by a baby or young child, often the remnants remain resident in the mouth, and can contribute to accumulation of bacteria and subsequent tooth decay. Thus, mouth rinsing is used on occasion, usually until a child is of sufficient maturity to engage in tooth brushing.

Various structures have been developed to promote oral hygiene in combination with a baby bottle. For example, U.S. Pat. No. 4,856,995 discloses a multiple reservoir nursing bottle which, when using a mouth cleansing agent, is switched between reservoirs to introduce water or other cleansing following consumption of the liquid beverage in the bottle. Other similar structures are found in U.S. Pat. Nos. 6,666,345; 5,353,964; 5,960,971; 5,897,007; 5,617,966 and 5,060,811, and a method of infant feeding having two milk products is disclosed in published Application No. US 2002/0035997 A1.

Thrush is a painful bacterial infection of the mouth and throat, which is caused by remnants of infant formula and milk remaining in the mouth after consumption. The present invention is designed to prevent that.

SUMMARY OF THE INVENTION

The invention is directed to a fillable dispensing receptacle having a portion formed for containing a liquid to be dispensed subsequent to another liquid. It comprises first and second reservoirs, with the reservoirs being in series with the first reservoir being forward the second reservoir and a normally closed, suction-activated, one-direction valve communicating between the first and second reservoirs. The valve is operable upon a predetermined suction in the first reservoir to open to permit expulsion of liquid from the second reservoir into the first reservoir for subsequent consumption by the infant or person using the receptacle.

In accordance with one form of the invention, the reservoirs form compartments of a flexible pouch, with the first reservoir having an open mouth shaped to engage a bottle holder. The second reservoir contains a cleansing agent for aiding inhibition of tooth decay, and preferably the cleansing agent is water, although any non-sugared liquid or other cleansing agent can be used.

In another form of the invention, the reservoirs form compartments of a re-usable container having an opening at one end of the first reservoir which is shaped to engage a removable nipple. In this form of the invention, a filling implement is provided for introducing the mouth cleansing agent into the second reservoir. In one embodiment, the filling implement comprises a plug that can be opened and closed. In another embodiment, the filling implement comprises a removable cap on the container, opposite to the opening.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
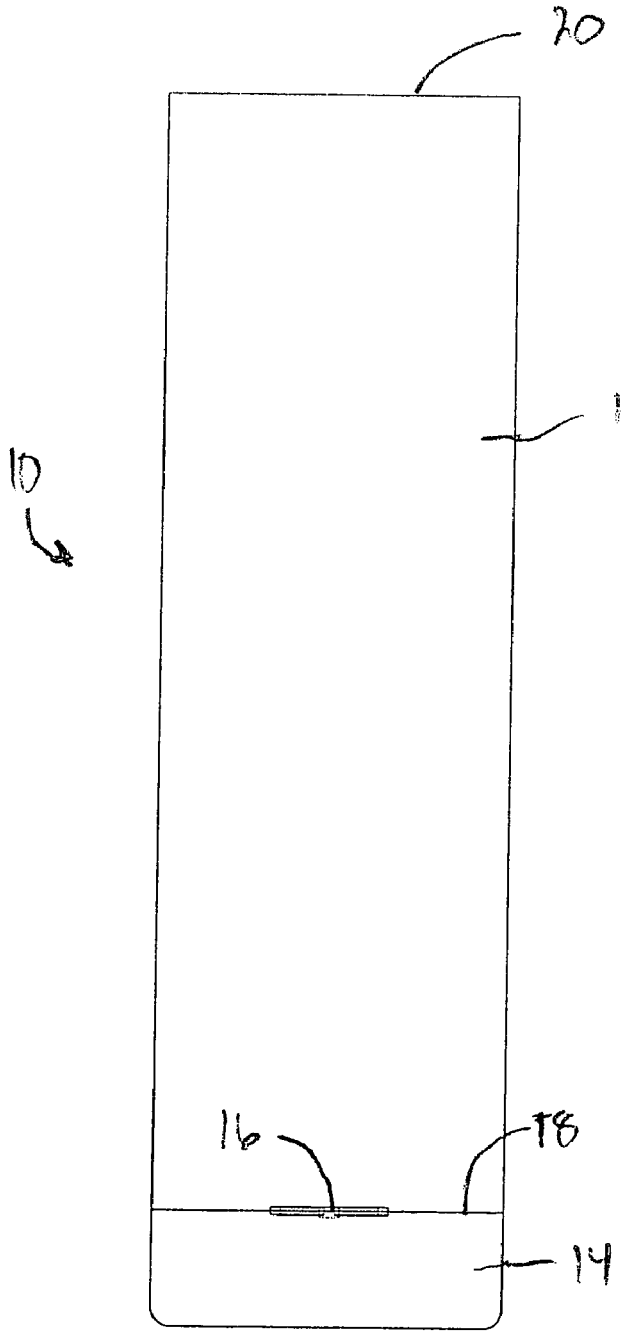
FIG. 1 is an elevational illustration of a first form of a dispensing receptacle according to the invention, comprising a flexible pouch.

A first form of a fillable dispensing receptacle according to the invention is shown generally at 10 in FIG. 1. The receptacle 10, in this form of the invention, is a flexible, disposable pouch, and includes a first reservoir 12 and a second reservoir 14 which form compartments of the flexible pouch forming the receptacle 10. As illustrated, the reservoirs 12 and 14 are in series, with the first reservoir 12 being forward of the second reservoir 14.

The second reservoir 14 is a sealed structure with the exception of a valve, discussed immediately below. That is, the second reservoir 14 is self-contained and the receptacle 10 can be provided with a desired liquid already installed in the reservoir 14. The first reservoir 12, on the other hand, is open in that it is available for filling by the user as explained in greater detail below.

A normally closed, suction-activated, one-direction valve 16 is provided in a wall 18 separating the first reservoir 12 from the second reservoir 14. The valve 16 is operable to permit liquid in the second reservoir 14 to be expelled through the valve 16 into the first reservoir 12. However, since the valve 16 is a one-direction valve, any liquid in the first reservoir 12 cannot flow in the opposite direction, into the second reservoir 14.

The valve 16 is normally closed, so that liquid in the second reservoir 14 remains therein. However, the valve 16 is suctioned-activated by the user so that when an appropriate suction (that is, an appropriate vacuum) occurs in the first reservoir 12, the suction causes the valve 16 to open, expelling the contents from the second reservoir 14 into the first reservoir 12. The valve 16 is formed so that normally, the contents of the first reservoir 12 are consumed by the infant or person using the receptacle 10, and then, only after the liquid contents of the first reservoir 12 have been consumed and the person continues to suck (and therefore create a vacuum in the first reservoir 12) does the valve 16 open to allow the contents of the second reservoir 14 to flow into the now-vacated first reservoir 12.

As illustrated, the first reservoir 12 has an open mouth 20 shaped to engage a conventional bottle holder in a conventional fashion. Therefore, the bottle holder is not illustrated. As is typical with a disposable flexible pouch when installed in a conventional bottle holder, the mouth 20 extends over and around one end of the bottle holder and a nipple is then applied thereover after the first reservoir 12 has been filled with an appropriate liquid, such as milk or juice.

Figure 2:
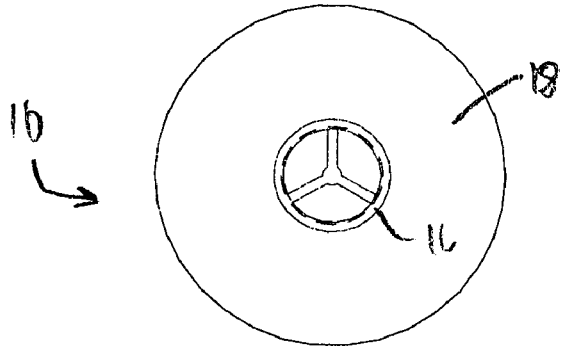
FIG. 2 is a top plan view thereof.

In use, the form of the invention as illustrated in FIGS. 1 and 2 is normally sold with a mouth rinsing agent, such as water, already installed in the second reservoir 14. Then, in use, the receptacle 10 which is in the form of a flexible pouch is installed in a conventional bottle holder, with the mouth 20 open over one end of the bottle holder. The first reservoir 12 is then filled, a nipple is applied, and the infant or other individual consuming the liquids from the receptacle 10 then commences that consumption. After the first reservoir 10 has been emptied, the infant will continue to suck, and that suction will build the vacuum in the now-collapsed first reservoir 12. With sufficient suction, the valve 16 opens, and the liquid contents of the second reservoir 14 are then expelled into the first reservoir 12, and the infant then consumes that liquid, as well. The liquid in the second reservoir 14, once released, is consumed to clean and rinse out the mouth of the infant.

Figure 4:
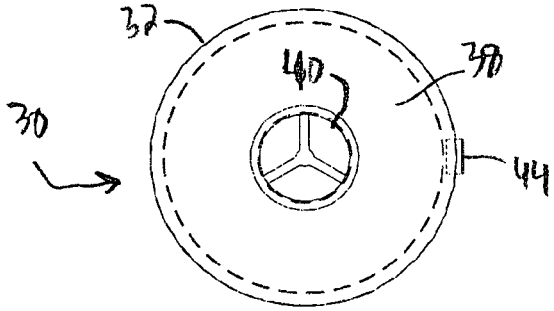
FIG. 4 is a top plan view thereof, with the nipple omitted.
Figure 3:
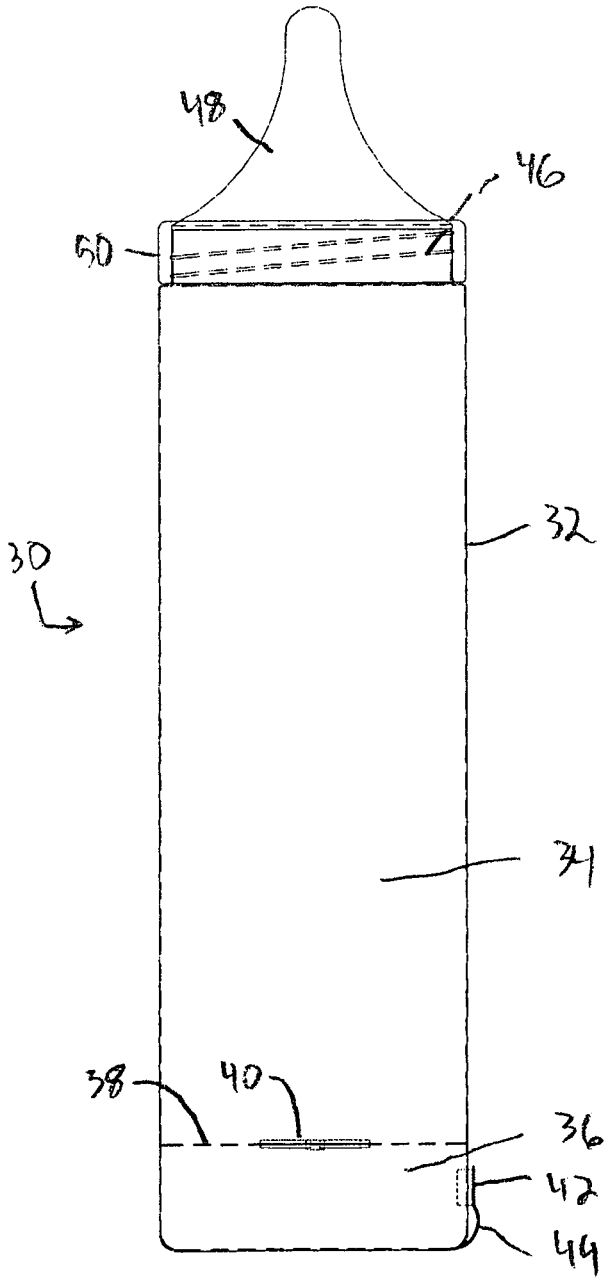
FIG. 3 is an elevational view of a second form of the invention, comprises a container, and having a removable nipple secured to one end.

A second form of the invention is shown in FIGS. 3 and 4. In this form of the invention, a receptacle 30 is provided in the form of a rigid or semi-rigid container 32 having, very similar to the first form of the invention of FIGS. 1 and 2, a first reservoir 34 and a second reservoir 36.

Just as in the first embodiment of the invention, the receptacle 30 has a wall 38 in which a normally closed, suction-activated, one-direction valve 40 is installed. The valve 40 operates in the same fashion as the valve 16 of the first form of the invention.

Because the receptacle 30 is in the form of a reuseable container 32, these must be means provided to insert water or other liquid in the second reservoir 36. In this embodiment, a plug 42 is provided, which can be opened and closed to allow insertion of liquid into the second reservoir 36. The plug 42 may have a tether 44 to guard against loss of the plug 42 when removed to allow liquid to be installed in the second reservoir 36.

The first reservoir 34 is topped by a threaded mouth 46, as in a conventional baby bottle or the like. When the receptacle 30 is used, and in a conventional fashion, a nipple 48 and nipple ring 50 are applied to the threaded mouth, after the first reservoir 34 has been filled with a desired liquid, to then allow consumption from the receptacle 30 in the normal fashion, using the nipple 48.

Figure 6:
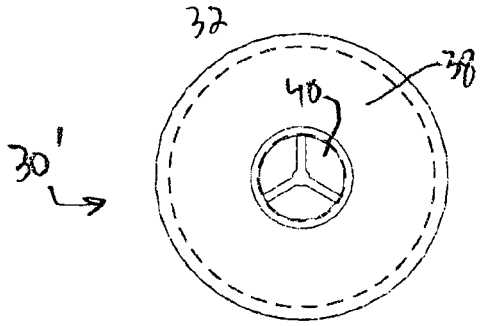
FIG. 6 is a top plan view thereof, with the nipple omitted.
Figure 5:
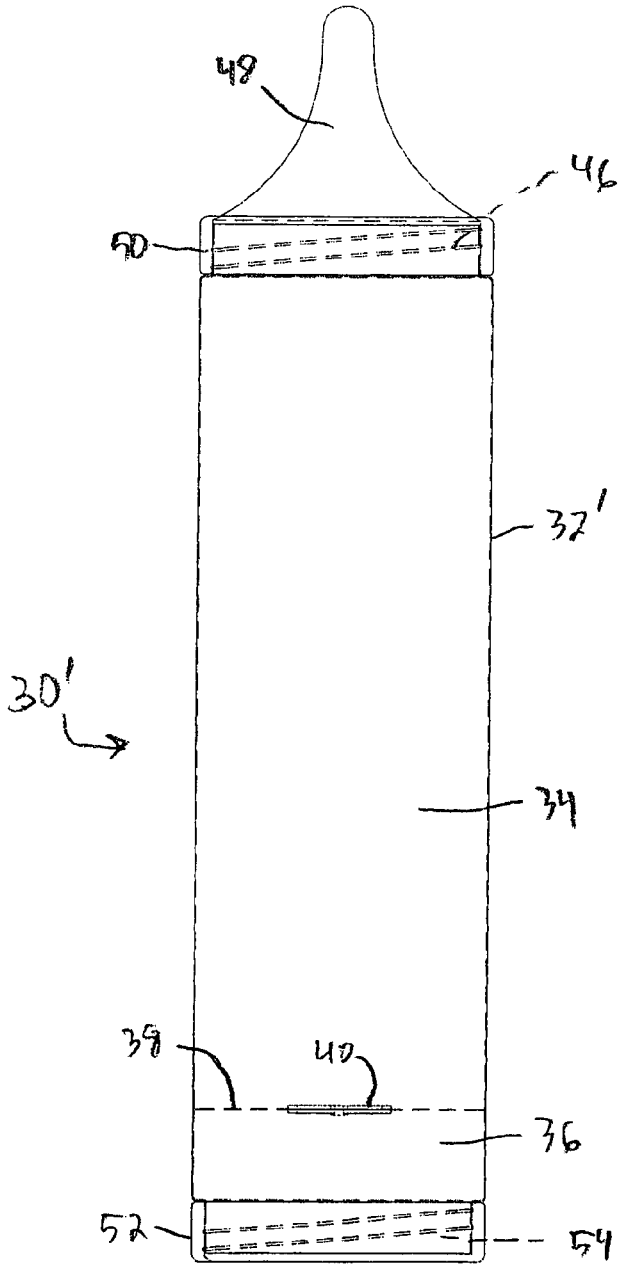
FIG. 5 is an elevational illustration of a modification of the form of the invention shown in FIG. 3, with a different means of accessing the second compartment.

A modified version of the receptacle 30 is shown in FIGS. 5 and 6 as the receptacle 30'. When elements shown in FIGS. 3 and 4 on the one hand and FIGS. 5 and 6 on the other are the same, those elements bear the same reference numerals. Items bearing the same reference numerals are thus not described in greater detail.

In the form of the invention shown in FIGS. 5 and 6, the plug 42 is omitted, and, instead, the receptacle 30' has a cap 52 threadedly and removably secured to a second mouth 54 at an opposite end of the modified container 32'. For filling of the second reservoir 36, the cap 52 is unscrewed from the mouth 54, and the second reservoir 36 is then filled with a desired liquid and the cap 52 reapplied. The second liquid is then contained in the second reservoir 36 until consumed in the same fashion as consumption occurs in the form of the invention shown in FIGS. 3 and 4.

The invention provides a simple, yet very effective, means of providing a second liquid once the primary, first liquid has been consumed. The second liquid can be for additional nutrition, and include medicine, vitamins and the like, or can simply be water or any other mouth cleansing agent to be consumed following consumption of the liquid in the first reservoir. The invention, in the first form of FIGS. 1 and 2, can be used in connection with a typical body holder where the receptacle 10 is discarded after use, or can be a self-contained structure as illustrated in FIGS. 3 through 6, where the receptacle can be used and reused many times. The invention can also be used with medicine, vitamins or the like in the second reservoir which are consumed easily without knowledge of baby or patient.

Various changes can be made to the invention without departing from the spirit thereof or scope of the following claims.

What is claimed is:

1. A fillable dispensing receptacle having a portion formed for containing a liquid to be dispensed subsequent to another liquid, comprising a) a first reservoir and a second reservoir, said reservoirs being in series with said first reservoir being forward said second reservoir, b) a normally closed, suction-activated, one-direction valve communicating between said first and second reservoirs, said valve being operable upon a predetermined suction in said first reservoir to open, after contents in said first reservoir have been expelled, to permit expulsion of liquid from said second reservoir into said first reservoir, and a filling implement for introducing a mouth cleansing agent into said second reservoir, said filling implement comprising a plug and a tether attached to said plug to guard against loss of said plug when removed, to allow filling of said second reservoir, c) said plug positioned between a lowermost portion of said second reservoir and below said first reservoir.

2. The dispensing receptacle according to claim 1 in which said second reservoir contains a cleansing agent for aiding inhibition of tooth decay.

3. The dispensing receptacle according to claim 2 in which said cleansing agent is water.

4. The dispensing receptacle according to claim 2 in which said reservoirs form compartments of a container having an opening at one end of said first reservoir shaped to engage a removable nipple.

5. A dispensing bottle having a portion formed for containing a liquid to be dispensed subsequent to another liquid, comprising a) an elongated container having an opening at one end, b) first and second reservoirs in said container, said reservoirs being in series with said first reservoir being forward said second reservoir, c) a normally closed, suction-activated, one-direction valve communicating between said first and second reservoirs, said valve being operable upon a predetermined suction in said first reservoir to open, after contents in said first reservoir have been expelled, to permit expulsion of liquid from said second reservoir into said first reservoir, and d) a mouth cleansing agent contained in said first reservoir, and a filling implement for introducing a mouth cleansing agent into said second reservoir, said filling implement comprising a plug and a tether attached to said plug to guard against loss of said plug when removed, to allow filling of said second reservoir, e) said plug positioned between a lowermost portion of said second reservoir and below said first reservoir.

* * * * *